United States Patent [19]

Akiko et al.

[11] Patent Number: 4,735,218

[45] Date of Patent: Apr. 5, 1988

[54] TOBACCO FILTER

[76] Inventors: Kondo Akiko; Kondo Kiyo, both of 396, Minemachi, Utsunomiya-Shi, Tochigi 321, Japan

[21] Appl. No.: 866,494

[22] PCT Filed: Sep. 9, 1985

[86] PCT No.: PCT/JP85/00501

§ 371 Date: May 7, 1986

§ 102(e) Date: May 7, 1986

[87] PCT Pub. No.: WO86/01692

PCT Pub. Date: Mar. 27, 1986

[30] Foreign Application Priority Data

Sep. 9, 1984 [JP] Japan ..... 59-188706
Apr. 8, 1985 [JP] Japan ..... 60-0733763

[51] Int. Cl.[4] ..... A24D 3/08

[52] U.S. Cl. ..... 131/331; 131/340; 131/342

[58] Field of Search ..... 131/331, 340, 342

[56] References Cited

FOREIGN PATENT DOCUMENTS 4946856 12/1974 Japan .
59122092 8/1984 Japan .

*Primary Examiner*—V. Millin
*Attorney, Agent, or Firm*—C. O. Marshall, Jr.

[57] ABSTRACT

Tobacco filter using a smoke filter comprising a processed product of fruiting body of Bacidiomycetes of bracket fungus or its analogue or mycelium or processed product of the Bacidiomycetes. This filter is remarkably effective in adsorbing tar and nicotine, harmful materials of the particle phase component of tobacco smoke and can remove harmful materials of gas phase, making the smoke taste light and mild, and also remove carcinogens such as 3,4-benzopyrene.

2 Claims, 5 Drawing Sheets

TOBACCO FILTER

BACKGROUND OF THE INVENTION

1. Technical Field

The present invention relates to a tobacco filter which is filled in a tobacco pipe or integrated in a cigarrette in order to remove harmful components such as tar and nicotine as well as carcinogens from tobacco smoke.

2. Prior Art

In recent years, harmful components of tabacco smoke are creating problems. Particle-phase components such as tar and nicotine have long been known to be the harmful substances, and in order to remove them, smoke filters have been integrated into cigarettes and filled into tobacco pipes. These filters use fibrous materials such as natural cellulose and acetate, or filtering materials of the continuous pneumatophore type. These materials can adsorb and remove tar and nicotine to some degree, but not sufficiently. Besides, they are not effective in removing harmful gas-phase components from the tobacco smoke.

Consequently, compound filters using the above-mentioned fibrous materials or other various filtering materials attached or filled with the activated charcoal are used to remove tar and nicotine as well as harmful components of gas phase. However, tar and nicotine still cannot be removed sufficiently, and in order to remove them sufficiently, a large quantity of the filtering material is required, which obstructs attempts to make a compact filter for use with tobacco pipes and cigarrettes. It also increases the resistance against smoke passage, resulting in the decreased enjoyment of smoking.

In addition, the activated charcoal is said to be insufficiently effective in removing the harmful gas-phase components, and actually cannot remove, in particular, carcinogens such as 3,4-benzopyrene at all.

In this circumstance, for the pupose of removing, in particular, the gas-phase carcinogens, a method was developed to attach lactic or egg protein, or a mixture thereof to the fibrous filtering materials (Japanese Patent Provisional Publication No. 73/19800). Although it is reported to have a certain effect of removing the carcinogens, it also has several disadvantages such as the decreased enjoyment of smoking because of the larger resistance against smoke passage, and the tendency to deterioration in the air at a room temperature, compared to the filters with no such protein attached to the filtering materials. Besides, the said protein itself does not provide a strong effect of removing the particle-phase components such as nicotine and tar, and therefore, cannot be expected to improve the effectiveness in removing the particle-phase components. By granulating the lactic protein, the problem of smoke pass resistance can be eased to some degree (Japanese Patent Provisional Publication No. 75/126899). In this case, however, the effectiveness in removing the harmful gas-phase components is affected in turn.

Another type of tobacco filter is also offered with biopolymer such as serum albumin and yeast nucleic acid filled into the cellulose filtering material. This type of filter can adsorb 3,4-benzopyrene, but still not sufficiently. And, since it may be deteriorated when kept in the air at a room temperature, care should be taken to keep it sealed until actually used, and to open it just before use. In addition, the said biopolymer itself does not have a high capability of removing the particle-phase components such as nicotine and tar, and therefore, cannot be expected to improve the effectiveness on these components.

Still another type of filter is that which has chlorella filled into or attached to the fibrous material. It is reported to be effective in adsorbing 3,4-benzopyrene. However, it also seems to have a tendency to deterioration, and chlorella itself does not have a sufficient effect in removing tar and nicotine.

SUMMARY OF THE INVENTION

Accordingly, an object of this invention is to provide a new filtering material that can sufficiently remove the harmful particle-phase components of tobacco smoke such as tar and nicotine with just a small amount of filtering material, and thus solve the problem which cannot not be resolved by the conventional tobacco filters.

A further object of this invention is to provide a new filtering material effective by itself in removing both the gas-and particle-phases of harmful components of tobacco smoke, and which can not be realized by the conventional filtering materials.

Another object of this invention is to provide a smoke filtering material which can be easily handled and that is stable if kept in the air at a room temperature, without fear of deterioration.

Another object of this invention is to provide a tobacco filter which maintains an excellent smoke flavor without impairing the taste of tobacco smoke, thus resolving the disadvantages of the conventional filters that the taste and flavor of tobacco smoke are compromised by the effectiveness in removing the harmful components.

Still another object of this invention is to provide a compact tobacco pipe easy to handle, and an integrated cigarette filter that can remove the harmful smoke components.

This invention is based on the discovery that the powdery, fibrous, cottony, or woolly product processed from the fruiting body of Polyporaceae or its analogous Mucronoporaceae (both generally called Fomes) or mycelium thereof is quite effective in adsorbing the harmful components of tobacco smoke.

The fruiting body and mycelium of Polyporaceae provide an epoch-making efficiency much larger than that of any other conventional filtering material, in adsorbing the particle-phase components of tobacco smoke such as tar and nicotine.

They are also effective in removing the gas-phase harmful components, and can remove carcinogens such as 3,4-benzopyrene. In addition, they also can remove irritating gas-phase components (presumably acetaldehyde and acrolein), making the smoke taste light and mild.

Conventional tobacco filters cannot remove tar and nicotine sufficiently without impairing the smoke taste because of the increase in the smoke passage resistance, while the new filter of this invention can greatly lower the smoke pass resistance with the similar removal efficiency. The greater part of the theory of this efficiency is still unknown, although any of the following factors are supposed to work independently or together with each other:

(1) Some substances contained in Polyporaceae may be functioning.

(2) The organic structure of Polyporaceae is intrinsically leathery, corky, spongy, felty, or porous and woody, and is suitable as a filtering material. In particular, the microscopic or cytological structure may contribute to the removal of the smoke components.

(3) As descrioed later, Polyporaceae have a specific organic structure that can be easily processed to a cottony or woolly product, and can be formed into filters by itself.

Microscopic munute structure and relatively coarse structure coexist in the crushed product of *Polyporaceae bacidiomycetes.* And, this seems to be the reason why a good filtering effect can be obtained even by the relatively coarse product crushed by a sawdust chipper or the like, as described later. The cottony or woolly product seems to be richer with the minute structure, and therefore, provides a larger filtering effect.

The structure and components of the fruiting body or mycelium of *Polyporaceae bacidiomycetes* vary depending on the genera and species. However, they commonly contain specific polysaccharides, ergosterol, fatty acid, amino acid, carbohydrate, various organic minerals, various saccharides, decomposition enzymes, and coenzymes. The structural feature of the fruiting body thereof is very specific, e.g. porous and woody, corky, spongy, felty, or leathery. Such specific feature and active components including enzymes and biopolymers are considered to work together to remove the harmful components of tobacco smoke, and to provide the epoch-making, active filter. In this invention, the powdery, fibrous, cottony, or woolly material obtained by processing of *Polyporaceae becidiomycetes* is used by itself as the filter for removing the smoke components of tobacco, or independently or dispersed within or attached to an appropriate carrier so as to be used as the filter for removing the components of tabacco smoke. The tobacco filter of this invention may be either integrated into a cigarrette or built into a tobacco pipe.

Since the Bacidiomycetes filtering material of this invention provides much larger adsorption than any other usual filtering material, the effect of removing the smoke components can be compared and confirmed at a glance by the selective change in color of the Bacidiomycetes filtering material, when it is set next to a normal filtering material, for example, fibrous acetate, with the joint part thereof made externally visible.

DESCRIPTION OF THE PREFERRED EMBODIMENTS

Figure 1A:
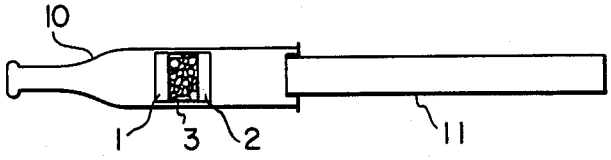
FIG. 1 (A) and (B) are general views showing the sectional structures of a pipe used in the experiments for the tobacco filter of this invention and a pipe used as the control.

The features and specific components of *Polyporaceae bacidiomycetes* and its analogous Bacidiomycetes important for this invention are listed as follows:

(1) *Ganoderma lucidum* (Fr.) Karst or its analogues (*Fomes japonicus* Fries)

The fruiting body has a well grown stem, and a liver-shaped or round cap. The surface of the stem and cap is covered with a hard shell which a varnish-like gloss due to some secretion. The bottom side of the cap is white. The upper layer of the flesh is whity, and the lower layer is cinnamon. The dry flesh becomes corky. Components thereof include ergosterol, polysaccharides, protein, organic acid, resin, coumarin, and mannitol as well as various enzymes.

(2) *Elfvingia applanata* (Pers.) Karst

The fruiting body has a cap with the top side covered with a thick, hard shell, and the inside flesh is felty and chocolate in color. The components thereof include polysaccharides, ergosterol, ubiguinone, and coenzyme Q as well as various decomposition enzymes.

(3) *Coriolus versicolor* (Fr.) Quel

The cap is semicircular, and has trichome on the surface. The flesh is rather hard and leathery, and white in color. It contains specific polysaccharides.

(4) *Fomitopsis pinicola* (Fr.) Karst, or *Fomes pinicola* (Swartz) Fries

The top side of the cap has a resin-like gloss, and the flesh is woody in structure, and the color of light wood.

(5) *Fomes formentarius* (Fr.) Kickx

The top side of the cap is tough because it is covered with a hard shell, and the bottom side is light gray. The flesh is felty, and yellowish brown.

(6) *Phellinus igniarius* (L. exFr.) Quel or its analogue, or *Phellinus linteus* ($B_{ERK}$ et curt Aoshima)

The structural feature is woody and porous.

Not only the fruiting body of the above-mentioned species of *Polyporaceae bacidiomycetes* or its analogue, Mucronoporaceae, but also the sawdust and/or crushed product of the dead wood and/or aged wood on which the mentioned fungi have grown, especially the portion where vast amount of hyphae exist, can be used as the filtering material of this invention. In addition, the mycelium proliferated by the organic culture can also be used.

The preferable methods of processing the fruiting body or mycelium of Bacidiomycetes for implementing the filter of this invention are given below.

(1) Processing into a cottony or woolly product

Of the above-mentioned species, the corky, felty, leathery, or woody flesh of the fruiting body of *Ganoderma lucidum* (Fr.) Karst, *Fomes formentarius* (Fr.) Kickx, or *Elfvingia applanata* (Pers.) Karst, or any other appropriate species in Bacidiomycetes (with the hard surface removed, if necessary) is cut into small pieces of a suitable size, and then loaded into a hammer crusher (electric crusher) in which blows and cuts are repeated. Then, through a screen with an appropriate mesh (2 to 6 mm, for example), the cottony or woolly product of the fruiting body is discharged. A crusher such as the vertical crusher (electric type) manufactured by Howa Kikai Kogyo K.K. under the tradename LAIND MIZER is used for this processing operation. The corky, felty, spongy, or leathery flesh of the fruiting body becomes the best cottony or woolly product, which is especially suitable to this invention and provides an excellent effect in removing the smoke components. The rather soft, woody fruiting body is the second best for processing into the cottony product. After the primary processing, it may be additionally processed by an electric mill into a finer cottony product. Following is additional information on the cottony or woolly product. When loaded into the said electric crusher (tradename LAIND MIZER), Bacidiomycetes such as Fomes is blown and crushed repeatedly with a hammer located inside the crusher. This machine has a screen at the outlet so that the crushed product larger than the mesh is automatically fed back to the hammer section for further blows with the hammer. The crushed product of Fomes does not become powdery by the repeated blows with the hammer, like the usual materials do, but changes into a cottony or woolly product with a three-dimensional fiber structure. *Polyporaceae bacidiomycetes* or its analogues are characterized in that blowing it repeatedly generates more or less the cottony or woolly product. The finer mesh screen makes the hammer blowing period longer, and generates a finer cottony or woolly product, resulting in the larger effect in removing the smoke components.

(2) Processing by sawdust chipper and/or electric mill

The fruiting body of *Polyporaceae bacidiomycetes* or its analogues can be used as the filter of this invention, after it is processed into the product like sawdust by a sawdust chipper which is usually used for producing sawdust. It may be further powderized by an electric mill to produce a finer powdery product for use as the filtering material, which provides a larger effect of removing the smoke components. In the examples of the processing by the sawdust chipper, as given later, the product is discharged through the screen with a mesh of 3.5 mm, and then powderized by the electric mill. Even by using this method only, *Coriolus versicolor* (Fr.) Quel may be processed into the rough cottony product.

(3) The flesh of Polyporaceae such as *Fomes formentarius* (Fr.) Kickx, *Elfvingia applanata* (Pers.) Karst, and *Ganoderma lucidum* (Fr.) Karst is sliced into pieces, if necessary, and then put into the cyclic operation so that is is beaten and softened, soaked in 2.5% solution of potassium nitrate, and then dried in the shade. By repeating this cycle, it is changed into the cottony state. Then, the product is further processed by the above-mentioned hammer crusher, electric crusher, or sawdust chipper, if necessary.

In addition to the species of *Polyporaceae bacidiomycetes* or its analogues, as above-listed, there are other families or species in Bacidiomycetes such as *Polyporus officinalis* (Vill.) Fries, *Lasiosphaera fenzlii* Reichardt, and Daedalea, which are very easy to process, and useful as the filtering material for this invention.

These processed filtering materials of Bacidiomycetes can be used in such manners as to be dispersed in or mixed with other material such as activated charcoal, zeolite, cellulose, continuous pneumatophores, or acetate fiber, or inserted between the layers of any one of the said carriers, or used just by themselves. Examples of performance tests on the tobacco filters of this invention are given below.

Figure 1B:
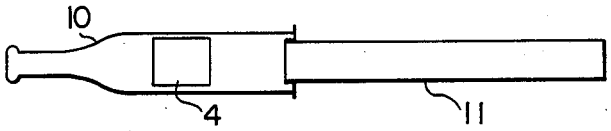

First of all, an example of preliminary test is described, which was performed to confirm the effect of the filtering materials of this invention. In this test the standard method of tobacco test was not employed, and the continuous smoking method employed instead. However, it was performed consistently under the same conditions, so that the function of the filtering materials of this invention can be confirmed by the relative data obtained from the test results. As seen in FIG. 1 (A), the test was made with a different type of the Bacidiomycetes filtering material filled in each plastic pipe (10). In FIG. 1 (A), the fibrous acetate filters (1) and (2) are arranged and the crushed product of the fruiting body or mycelium of Bacidiomycetes (3) is inserted between them in the plastic pipe (10) with a cigarette (11) inserted in it.

On the other hand, the pipe of the same structure as FIG. 1 (A) except that the filtering portion consists of the fibrous acetate layer (4) only is used as the control, as shown in FIG. 1 (B).

The smoke components that passed through each pipe of tnis invention and the control were collected with a submicron paper filter in the suction filter, and the quantity collected was measured. The typical test results are given below.

The tobacco used for the experiments was "PEACE" and identical continuous smoking conditions were devised for each of the test cases. The collection amount (by weight) of a relatively thick paper filter was set at 100, and the results expressed as the (relative weight) value of the amount collected by the filter of this invention, with respect to the 100 standard. The internal length of the pipe in which the crushed fruiting body of Bacidiomycetes was filled, was approximately 4 mm, and the total filter length was approximately 8 mm. From the results of the experiment, it can be seen that in general, the smoke filtration effect of *Polyporaceae bacidiomycetes* is remarkable, and that an extremely great smoke component removal effect can be obtained, especially when cottony or woolly processing are performed. In particular, there is a particularly large effect for powders of felty *Elfingia applanata* (*Fomes applanta*) and *Fomes formentarius*, corky *Ganoderma lucidum* (*Fomes japonais*) and leathery *Coriolus versicolor* (*Polystictus versicolor*), with there being a large removal of tar and nicotine harmful components in the particle phase. The typical test results are given below in Table (I) through Table (III).

Test (I) (Table 1)

| Sample | Collected Amount | Remarks |
|---|---|---|
| Control | 100 | Acetate filter only. |
| Fruiting body of *Ganoderma lucidum* (*Fomes japonicus*) (cottony product) | 34 | Processed product 25 mg |
| Fruiting body of *Fomes formentarius* (cottony product) | 37 | Processed product 17 mg |
| Fruiting body of *Coriolus versicolor* (*Polystictus versicolor*) (cottony product) | 28 | Processed product 38 mg |

Test II (Table II)

| Sample | Collected Amount | Remarks |
|---|---|---|
| Control | 100 | Acetate filter only. |
| Fruiting body of *Coriolus versicolor* (*Polystictus versicolor*) (product pulverized by sawdust chipper) | 85 | Pulverized product 40 mg |
| Fruiting body of *Corolius versicolor* (*Polystictus versicolor*) (processed by sawdust chipper, | 32 | Crushed product 30 mg |

-continued

Test II (Table II)

| Sample | Collected Amount | Remarks |
|---|---|---|
| and further by electric mill) | | |
| Fruiting body of *Ganoderma lucidum* (*Fomes japonicus*) (crushed by sawdust chipper) | 52 | Crushed product 32 mg |
| Fruiting body of *Fomes formentarius* crushed by sawdust chipper | 58 | Crushed product 25 mg |

Test III: Tests I and II were performed after hot water was used to extract the processed product of Bacidiomycetes from each of the above test filters. As a result, all filters provided almost the same figure as the control, indicating the loss of effect of the filters.

As the result of the above tests repeatedly performed, it was apparent that the cottony or woolly product of the fruit body of Bacidiomycetes is very effective in removing the smoke components (which means that the amount of smoke collected by the paper filter is decreased). With a Bacidiomycetes filter of just 4 mm long, the amount of smoke removed could be increased by 63 to 72% by weight, when compared with conventional fibrous acetate filters. Also, with the product crushed by the sawdust chipper (in the powdery state), 15 to 42% of the smoke could be removed. Furthermore, as apparent from the result of Test (III), the structure of the crushed product and the components of Bacidiomycetes seem to work together, because the effect disappears after the extraction of the components by hot water.

Either the cottony or woolly product, or the product crushed by the sawdust chipper or electric mill provides the larger effect with the finer grade of processed structure. The above-mentioned results are obtained by tests made on the fruiting body, and similar ones were also obtained by the test made on the mycelium using the crushed product of the dead or aged wood on which Bacidiomycetes had grown, and in particular, portions where a vast amount of hyphae had existed.

From the above data, it is apparent that *Polyporaceae bacidiomycetes,* in general is very effective in removing the smoke components. In order to further test this effect in detail, additional experiments were performed in the standard mode, as given below.

The structure of the pipe used in the experiments below was the same as illustrated in FIG. 1. That is, the powdery, cottony or woolly product (3) of *Polyporaceae bacidiomycetes* according to this invention was inserted between the fibrous acetate filters (1) and (2). The enlarged view of the filtering portion is given in FIG. 8, which shows the transparent cylinder (80) having an inner diameter of 7 mm, of cellophane, polyethylene, or the like, containing the fibrous acetate filters (1) and (2) of 3 mm each in length with the *Polyporaceae bacidiomycetes* filter (3) inserted between. The procedure and results of each of these tests are listed below.

Test IV

First, various test examples are given, which are made on the above-mentioned filters filled with various amounts of different species of *Polyporaceae bacidiomycetes.*

The smoking conditions are set as follows:

| Three filterless "HI-LITE" cigarettes were smoked each for 5 cm only. | |
|---|---|
| Smoking speed | 17.5 ml/s |
| Smoking time | 2 sec. smoking at intervals of 58 sec. |

Method of collecting the smoke components

The smoke components passed through the filter were collected by the submicron filter (manufactured by Toyo Roshi K.K.), and the collected amount after dehydration or the rough tar weight was measured, and compared with the control. The tables below show the proportion of the rough tar weight collected with various amounts of various *Polyporaceae bacidiomycetes* products filled in the pipe, to that of the control. The proporation of collected rough tar indicated in each table below means the relative value of the collected tar weight on the above-mentioned submicron filter when each filter of this invention is used, compared to the collected tar amount on the submicron filter when no filter of this invention is used (weight of *Polyporacease bacidiomycetes* product is zero), which is set to 100 as the control. Meanwhile, the removal ratio indicates the value obtained by "100—(proportion of collected rough tar)".

Test Result 1 - In the case of *Coriolus versicolor* (Fr.) Quel

| Weight of Polyporaceae | Control | 15 mg | 30 mg | 50 mg | 100 mg |
|---|---|---|---|---|---|
| Proportion of Collected Rough Tar | 100 | 42.1 | 26.3 | 21.0 | 10.5 |
| Removal Ratio | 0 % | 57.9 % | 73.2 % | 79 % | 89.5 % |

Test Result 2 - In the case of *Fomes formentarius* (Fr.) KicKx

| Weight of Polyporaceae | Control | 15 mg | 30 mg | 50 mg | 100 mg |
|---|---|---|---|---|---|
| Proportion of Collected Rough Tar | 100 | 31.5 | 21.1 | 10.5 | 9.5 |
| Removal Ratio | 0 % | 68.5 % | 78.9 % | 89.5 % | 90.5 % |

Test Result 3 - In the case of *Ganoderma lucidum* (Fr.) Karst

| Weight of Polyporaceae | Control | 15 mg | 30 mg | 50 mg | 100 mg |
|---|---|---|---|---|---|
| Proportion of Collected Rough Tar | 100 | 63.2 | 26.3 | 15.8 | 5.3 |
| Removal Ratio | 0 % | 36.8 % | 73.2 % | 84.2 % | 94.7 % |

Test Result 4

Powdery product of *Elfvingia applanata*

50 mg of the product filled in the pipe Collected rough tar 15.8 (against 100 for the control) (Removal Ratio: 84.2%)

Test V

Filterless "HI-LITE" was used as the test cigarette, and the structure of the pipe was arranged in the same manner as in the case of Test IV. Thus, under the same conditions as Test IV, the function of the filter was tested each time two "HI-LITE" cigarettes were smoked. The evaluation of the filtering function was based on the change in the amount of rough tar collected every time two "HI-LITE" cigarettes were smoked. The "Change in the collected rough tar" in this case shows merely the relative value. That is, the smoking conditions, under which 9.5 mg/piece of the rough tar is collected after passage through a filter structure the same as Test IV except for that there is no processed-product of Bacidiomycetes of this invention, is set as the "Control". Moreover, the weight of rough tar collected on the submicron filter (mg/piece) is given in the tables below, after passage through the processed product of Bacidiomycetes as mentioned above each table, and under the conditions set to the "Control".

| Test Result - In the case of 50 mg of *Corilus Versicolor* (Fr.) Quel | | | | | | |
|---|---|---|---|---|---|---|
| Number of cigarettes smoked | 0–2 | 3,4 | 5,6 | 7,8 | 9, 10 | 11, 12 |
| Change in the collected rough tar | 2 | 1.8 | 1.5 | 1.5 | 1.2 | 1.5 |

| Test Result - In the case of 50 mg of *Fomes formentarius* (Fr.) Kickx | | | | |
|---|---|---|---|---|
| Number of pieces smoked | 0–2 | 3,4 | 5,6 | 7,8 |
| Change in the collected rough tar | 1.2 | 1.2 | 1.0 | 0.5 |

Test VI

Testing Procedure

Filterless "HI-LITE" was used as the test tobacco. Three "HI-LITE" cigarettes were smoked each for 5 cm from the tip by repeated inhaling for 2 sec. at intervals of 58 sec. (at an inhaling speed of 17.5 ml/s) through the filter of this invention. The smoke which passed through the filter was introduced into the benzene solution, which was then analyzed by high speed liquid chromatography so as to measure the weight of the smoke components such as tar, nicotine and 3,4-benzopyrene (also called benzo (a) pyrene) which were collected in the benzene solution. This test was performed by the Food and Health Research Laboratories in the Japanese Institute of Food and Health, the research institute authorized by Ministry of Health and Welfare. The test results are listed below.

Test Results

When using a filter (PF-1) filled with 80 mg of cottony product of *Fomes formentarius:*

| | |
|---|---|
| Collected tar amount | 1.3 mg/piece |
| Collected nicotine amount | 0.16 mg/piece |
| Benzo (a) Pyrene (3,4-benzopyrene) | 2.9 ng/piece (Removal ratio 62%) |

When using a filter (PF-2) filled with 80 mg of rough cottony product of *Coriolus versicolor:*

| | |
|---|---|
| Collected tar amount | 1.2 mg/piece |
| Collected nicotine amount | 0.13 mg/piece |
| Benzo (a) Pyrene (3,4-benzopyrene) | 5.4 ng/piece (Removal ratio 35%) |

Meanwhile, 3,4-benzopyrene cannot be removed at all by regular fibrous acetate or activated charcoal filters, so that about 8 ng of benzo (a) pyrene is detected per cigarette.

In an example of using 100 mg of finer cottony product of *Coriolus versicolor,* the removal ratio of 3,4-benzopyrene is twice that of the rough cottony one as mentioned above, although the smoke resistance is somewhat increased. Generally speaking, just for removing the gas phase components such as 3,4-benzopyrene, the best effect can be obtained by processing *Polyporaceae bacidiomyceae* into powdery, cottony, or woolly state that is as fine as possible.

Besides, with *Elfvingia applanata* (*Fomes appalanta*) or *Ganoderma lucidum* (*Fomes japonicus* ), tar and nicotine can be removed by about 90%, and 3,4-benzopyrene can be removed by more than 50%.

In these examples, the smoke pass resistance may be set in the range of 5 mm to 15 mm (the smoke pass resistance is represented by the water height corresponding to the difference in pressure before and after the filter when the intake amount is set to 17.5 ml/s) in order to avoid substantially impairing the smoking enjoyment.

Examples of the preferable applications of this invention to the pipes and/or cigarettes are shown below.

Figure 2:
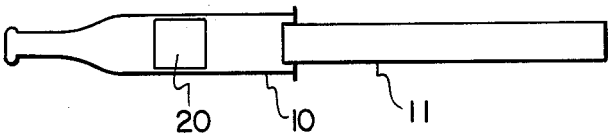
FIG. 2 is a general view showing the sectional structure of a pipe to which the tobacco filter of this invention is applied.

FIG. 2 is the general view of a pipe to which this invention is applied, in which (10) is the plastic pipe, (20) is the tobacco filter of this invention built into the said pipe, and (11) is the cigarette. FIGS. 3 to 6 show enlarged views of the Filter Part (20) of FIG. 2.

Figure 3:
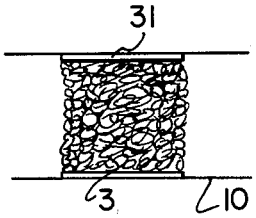
FIGS. 3 through 6 are enlarged sectional views of various embodiments of the pipe filter of FIG. 2.

FIG. 3 shows the tobacco filter used with the processed product (powder) of Bacidiomycetes (3) filled in the auxiliary pipe (31). For example, the filtering material (3) of the processed Bacidiomycetes may be wrapped in the cyrindrical form with a piece of paper, or received in a cylindrical vessel having a hole at each end.

Figure 4:
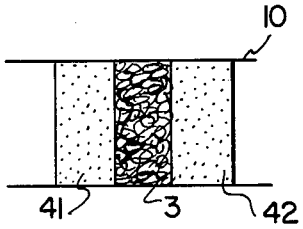

FIG. 4 shows the processed product (3) of Bacidiomycetes inserted between the filters of any other type, for example, fibrous acetate filters (41) and (42).

Figure 5:
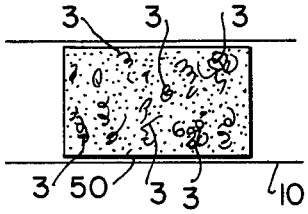

FIG. 5 shows the processed product (3) of Bacidiomycetes engaged or mixed in any carrier (50) that may pass the smoke components, such as various fibrous materials, activated charcoal, zeolite, continuous pneumatophore, or the like.

Figure 6:
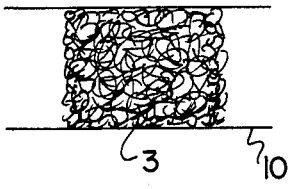

FIG. 6 shows the processed product (3) of Bacidiomycetes filled in the plastic pipe (10) when molded. Meanwhile, when an auxiliary cylinder of plastic (31) is used, the powdery product of Bacidiomycetes may be filled therein at the time of molding, for use in such a manner as illustrated in FIG. 3.

Figure 7:
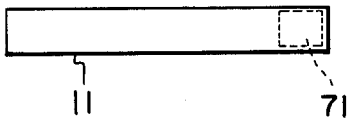
FIG. 7 is a general view of an embodiment of tnis invention, in which the tobacco filter is integrated into a cigarrette.

FIG. 7 shows an example of the tobacco filter (71) of this invention which is incorporated into the cigarette body (11). The mode of the filter (71) is the same as in the above-mentioned pipe.

Other preferable examples of pipes and cigarettes of this invention are shown below.

Figure 8:
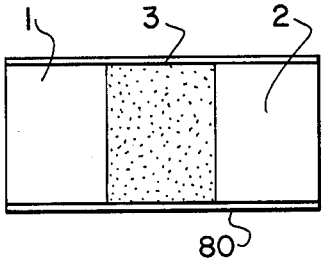
FIG. 8 is a section view, partly enlarged, of an embodiment of this invention, in which the tobacco filter is made externally visible.
Figure 9A:
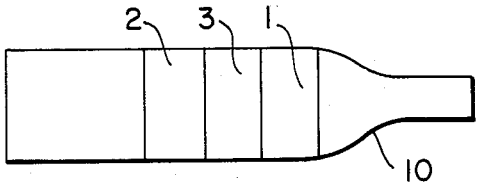
FIG. 9 (A), (B) and (C) show the change of a pipe to which the tobacco filter of this invention is applied in such a manner that the filter portion can be externally observed.
Figure 9B:
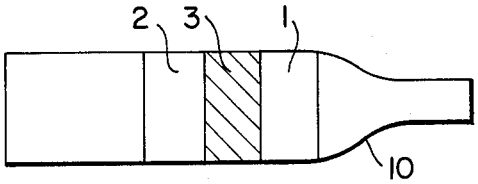
Figure 9C:
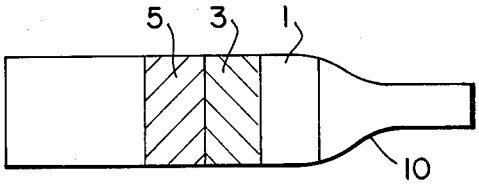

FIG. 8 shows a filter unit according to this invention. The fibrous acetate filters (1) and (2) of 3 mm each in length are arranged at each end of the transparent cylinder (80) of 7 mm inner diameter of cellophane, polyethyrene or the like, and the processed product filter (3) of *Potylthylene bacidiomycetes* is inserted in between. By loading this filter unit into a plastic pipe, the filter part can be externally observed, so that the removal of the smoke components can be confirmed by the change in color of the filtering material when the tobacco is smoked. FIG. 9(A) to 9(C) shows the change of pipe while in use, with the passage of time. In this figure, the white fibrous acetate filters (1) and (2) which are usually used as the tobacco filter are arranged in a transparent pipe (10), and the cottony product of *Coriolus versicolor* (3) is inserted in between. FIG. 9(A) shows the original state of the cottony processed-product of *Coriolus versicolor* (3) as well as the acetate filters (1) and (2), all of which are white in color. However, just after smoking a piece of tobacco, the processed product of this invention (3) changes to a dark brown, showing the adsorption of the harmful smoke component, while the fibrous acetate filters (1) and (2) remain white, as shown in FIG. 9(B).

This is caused by the capability of the filter of this invention to adsorb the harmful smoke components, which is much larger than that of the acetate filter. With the increase in the number of cigarettes smoked, the part (3) becomes darker and darker with the adsorption of more tar and nicotine, while the acetate filter (2) at the front gradually changed to brown. However, even after 10 pieces or more have been smoked, the acetate filter (1) at the rear remained unchanged as white. At that time, the parts (3) and (2) are dark brown, and in particular, in the processed cottony product (3) of *Coriolus versicolor,* the adsorpted tar and nicotine even formed into drops in places.

As described above, FIGS. 9(A) and (B) show an example of the compound filter arranging the processed material (3) of Bacidiomycetes of this invention in the form of layers and putting the usual colorless (or white) filters (2) and (1), if necessary, to the front and back sides of (3), and built in a pipe (10) with at least the filter part made transparent so as to be externally observed. It is quite useful since it allows the pipe user to recognize at a glance from the comparison of the color between the filters that the harmful smoke components are being removed.

As the effect can be seen only from the processed product (3) of Bacidiomycetes which becomes darker and darker, only the part (3) need be made visible from the outside, the filter may be formed with just the filtering material (3), with no acetate filter arranged to either side of the part (3), and the said filter part (3) may be made externally visible.

FIG. 9(C) shows another example using a material with excellent permeability and liquid holding capacity (liquid adsorptive filter) (5) so that the tar and nicotine dropped from the filtering material (3) can be adsorbed in order to improve the capability of holding the tar and nicotine. This allows the filter with even a small amount of the processed product of Bacidiomycetes to remove the smoke components of more cigarette. When the external visibility as above mentioned is not taken into consideration, this liquid adsorptive filter may be arranged to the rear end of the processed product of Bacidiomycetes (3). Sponge, foaming polystyrol, adsorptive paper or the like can be used as the liquid adsorptive filter.

In the case of visible construction as illustrated in FIGS. 9(A) to 9(C), it is preferable to use a white filter such as the cottony product of *Coriolus versicolor* as the processed filtering material (3) of this invention. However, *Elfvingia applanata* which is originally brown, or *Ganoderma lucidum, Fomitopsis pinicola,* or *Fomes formentarius* which is originally yellowish brown may also be used since it changes darker in color while usual acetate filters (1) remain white even after smoking, and therefore, can clearly indicate the filtering effect to the users.

Next, the degree of packing and the amount of the filtering material processed from Bacidiomycetes of this invention are described.

The filtering material processed from Bacidiomycetes of this invention provides the effect with only a few mg by weight, and can be used sufficiently for a pipe with 15 mg by itself (or inserted in the usual filters). For use with a pipe, the suitable amount is considered to be 15 to 100 mg, while for integration into the filtering part of a cigarette, suitable amount seems to be a few mg to 30 mg, although it is not necessarily limited to these values.

When the filtering material of this invention is to be packed into regular filters, the more tightly it is packed, the larger the fitering effect becomes. However, when using a large amount of the filtering material of this invention, for example, 50 to 100 mg, relatively loose packing provides a sufficiently high effect, and loose-packing is advantageous in that it decreases the air passage resistance, allowing more cigarettes to be smoked. In addition, when a large amount of the filtering material can thus be used, even the coarse structure of the crushed product of Bacidiomycetes of this invention will provide a sufficient effect. When the filter of the processed product of this invention is formed to 3 cm or more in length, nearly 100% of the smoke components can be removed. On the other hand, when a small amount of the filtering material is to be used, for example, about 15 mg of the cottony product, tight-packing of the filtering material of this invention between the usual filters does not increase the air pass resistance. On the contrary, it is preferable for providing the larger filtering effect. In this case, it is better to crush Bacidiomycetes into a finer structure.

INDUSTRIAL APPLICABILITY

As above-mentioned, the tobacco filter of this invention is advantageous in that it is more effective in removing both the particle- and gas-phase harmful components of tobacco smoke, than any other conventional tobacco fiter, while maintaing an excellent smoke flavor and taste, and that the smokers can easily confirm the effect of removing the harmful components. In view of these points, it is feasible for use as a smoke filter integrated into a smoke pipe or cigarette.

What we claim is:

1. A device for smoking tobacco, comprising a passage through which the user draws smoke, and a filter in said passage which comprises a fruiting body or mycelium of Polyporaceae or Mucronoporaceae.

2. A device according to claim 1, wherein the fruiting body or mycelium is woody, corky, felty, spongy, or leathery.

* * * * *